US005423422A

United States Patent [19]

Boire et al.

[11] Patent Number: 5,423,422

[45] Date of Patent: Jun. 13, 1995

[54] FLAT PANEL DISPLAY CONTAINER

[75] Inventors: William A. J. Boire, Chanhassen, Minn.; Thomas Oesterle, Colorado Springs, Colo.; Sidney A. Higgins, Maple Grove, Minn.

[73] Assignee: Empak, Inc., Chanhassen, Minn.

[21] Appl. No.: 209,457

[22] Filed: Mar. 14, 1994

[51] Int. Cl.[6] ..... B65D 85/30

[52] U.S. Cl. ..... 206/334; 206/454; 211/41

[58] Field of Search ..... 206/454, 455, 456, 334, 206/449; 211/41

[56] References Cited

U.S. PATENT DOCUMENTS

| | | | |
|---|---|---|---|
| 3,798,507 | 3/1974 | Damon et al. | 211/41 X |
| 3,807,622 | 4/1974 | Belcher et al. | 206/454 X |
| 3,915,307 | 10/1975 | Agarde | 211/41 |
| 4,029,208 | 6/1977 | Fickler et al. . | |
| 4,061,228 | 12/1977 | Johnson . | |
| 4,418,820 | 12/1983 | Nagle et al. | 206/334 |
| 4,427,114 | 1/1984 | Howell et al. . | |
| 4,446,966 | 5/1984 | Moloney . | |
| 4,484,381 | 11/1984 | Ellis et al. . | |
| 4,506,785 | 3/1985 | Seefeldt . | |
| 4,574,950 | 3/1986 | Koe et al. . | |
| 4,592,610 | 6/1986 | Bowls | 211/41 X |
| 4,706,819 | 11/1987 | Elliott . | |
| 4,763,781 | 8/1988 | Donalson et al. | 206/334 |
| 4,767,002 | 8/1988 | Malcolm . | |
| 4,815,601 | 3/1989 | Peterson et al. . | |
| 4,817,263 | 4/1989 | Donalson et al. | 211/41 X |
| 4,930,634 | 6/1990 | Williams et al. . | |
| 5,025,924 | 6/1991 | Watanabe . | |
| 5,228,568 | 7/1993 | Ogino et al. . | |

*Primary Examiner*—Bryon P. Gehman
*Attorney, Agent, or Firm*—Haugen and Nikolai

[57] ABSTRACT

The present invention is an apparatus for packaging, storage and transportation of flat panel displays. The apparatus has a base which receives a removable base cushion and two removable side cushions. Each cushion has a plurality of ribs defining a flat panel display receiving members. The side cushions are designed to accommodate a variety of flat panel display sizes. A cover mates with the base and further secures the flat panel displays within the flat panel display receiving members of the removable base and side cushions.

14 Claims, 14 Drawing Sheets

FLAT PANEL DISPLAY CONTAINER

FIELD OF THE INVENTION

This invention relates to a container for receiving a number of flat panel displays and independently supporting the displays for storage and transportation of the flat panel displays. More particularly, this invention relates to a container assembly having display supporting cushion members which are flexible and may be selectively positioned to accommodate displays of differing sizes.

BACKGROUND OF THE INVENTION

Increasingly, manufacturers of electronic equipment are using flat panel displays as the substitute for cathode ray tubes. Such flat panel displays comprise a panel of glass or other similar material having numerous coatings deposited thereon. The coatings which are widely divergent in nature act together to produce the images to be displayed. The manufacturing process used to make flat panel displays requires both high heat and the use of strong chemicals. Further, some of the coatings applied to the glass substrate are extremely thin. It is vitally important to avoid contact with anything which could scratch the coatings.

Various containers have been designed to receive and support flat panel displays. Such carriers are, for example, shown and described in U.S. Pat. No. 4,815,601 and U.S. Pat. No. 4,930,634. However, such containers do not adequately support the flat panel displays in an independent fashion. Further, the support elements used in such containers are not readily adjustable to store flat panel displays of a different size.

As a result, there still exists a need for a storage container for flat panel displays which can properly support flat panel displays of differing lengths. The present invention meets this need by providing such a storage container containing selectively adjustable flat panel display support cushions.

SUMMARY OF THE INVENTION

The present invention includes a base containing cushions for supporting the flat panel displays and is configured for robotic handling of the flat panel displays. The base and its cover are made from a hard plastic material and are configured for robotic handling. A bottom support cushion is positioned in the bottom of the base. A pair of side support cushions between which the flat panel displays are inserted are adjustably mounted in opposing relationship on the side walls of the base. The side support cushions contain a plurality of flat panel display receiving members for engaging the edges of the flat panel displays. The cover includes indented areas which cooperate with the side and base support cushions of the base to securely position the flat panel displays for storage and transportation.

The side cushions contain beads on each side edge for mating with slots located on the interior surface of the base. The beads are offset from one another. Each bead is adapted to be received in one of three slots on a interior surface wall of the base. This allows the user to insert the cushions to accommodate flat panel displays of different sizes. To further accommodate various sizes, each flat panel display receiving members of both the side and the bottom cushions has an arcuate wall with a plurality of various sized ridges. This further allows the cushions to accommodate various sizes of flat panel displays.

A principal object of the present invention is to provide a strong, rigid carrier for flat panel displays.

Another object of the invention is to provide such a carrier having a base and a cover and further having a bottom support cushion and two side support cushions which cooperate with indentations on the cover to snugly support the flat panel displays in a secure position.

A further object of the invention is to provide a flat panel display storage and transporting carrier which can accommodate flat panel displays of different sizes.

Still another object of the present invention is to provide a design which provides accurate indexing for robotic handling.

Other objects and advantages of the present invention will be apparent upon consideration of the following detailed description of the preferred embodiment in conjunction with the drawings provided.

DETAILED DESCRIPTION OF THE PREFERRED EMBODIMENT

Figure 1:
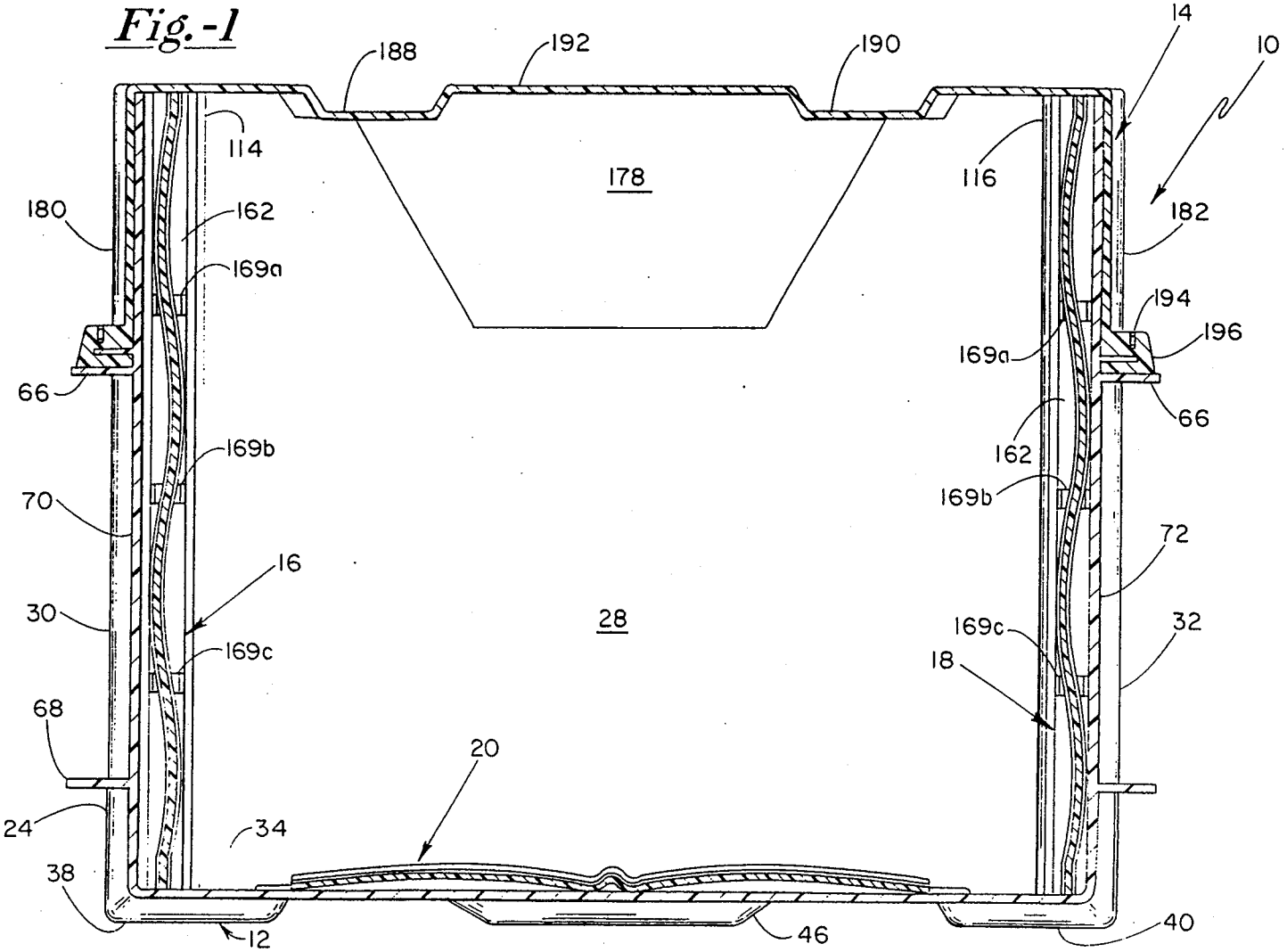
FIG. 1 is a cross sectional view of the flat panel display package of the present invention.
Figure 2:
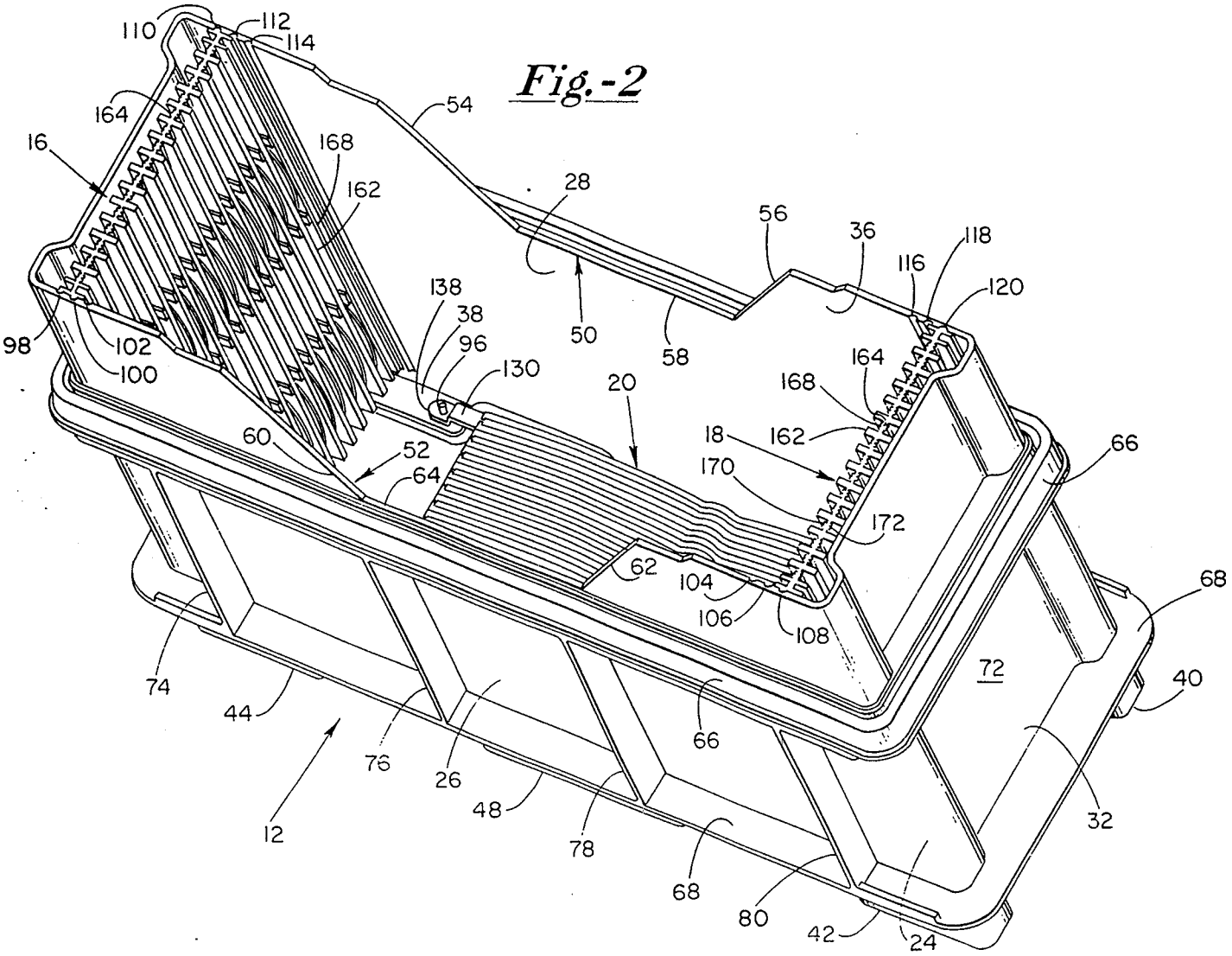
FIG. 2 is a perspective view of the interior of the base containing the support cushions of the present invention.

The present invention is a container for storing and transporting flat panel displays and is designated generally 10 in FIG. 1. The container 10 of the present invention is configured for robotic handling and includes a base 12 and a cover 14 containing two adjustable and flexible side support cushions 16 and 18 and a flexible bottom support cushion 20. The flat panel displays are received in slots of the adjustable side support cushions 16 and 18 and the base support cushions 20 as will be described in further detail. The cover 12 contains indentations to retain the flat panel displays within the slots of the base support cushion 20 and the slots of the side support cushions 16 and 18.

Turning now to FIGS. 1–5, the base which contains the side and base support cushions will be described in greater detail. The base 12 comprises an integrally formed outer shell 24 made of a sturdy, rigid plastic. Many suitable plastic materials are available. The material chosen should be able to withstand harsh chemicals and high temperatures without deforming. Such materials include polycarbonate or olefinic plastics. The outer shell 24 has a front wall 26, a back wall 28, a pair of end walls 30 and 32, a base floor 34, an open top 36 and six base support members 38, 40, 42, 44, 46 and 48. As stated earlier, the container is configured for robotic handling. To permit robotic insertion and removal of displays from the base 12, the front and back walls 26 and 28 include two cut-out areas 50 and 52 near the open top 52. Cutout area 50 consists of two opposing sloped edges 54 and 56 terminating in a edge 58 parallel to the floor 34. Likewise, cutout area 52 is defined by two opposing sloped edges 60 and 62 and an edge 64 parallel to the floor 34. Robotic tools are able to access the sides of the flat panel displays stored within the package 10 through the cut-out areas 50 and 52.

Two support ledges 66 and 68 are located on the base 12. Situated just beneath the cut-out areas 50 and 52 is the support ledge 66 which completely surrounds the base 12. The support ledge 66 serves as a stop for the cover 14. A second support ledge 68, which also surrounds the base 12 is located near the bottom. Both support ledges 66 and 68 provides robotic tool gripping surfaces. As shown, the ledges 66 and 68 are in a spaced apart parallel relationship to each other and completely surround the front wall 24, the back wall 28 and two end walls 30 and 32 of the base 12. Each end wall, 30 and 32, has a central area designated 70 and 72 respectively, which is recessed from the ends of the front and back walls 26 and 28. This arrangement permits easier gripping of ledges 60 and 62 by robotic tools.

Figure 6:
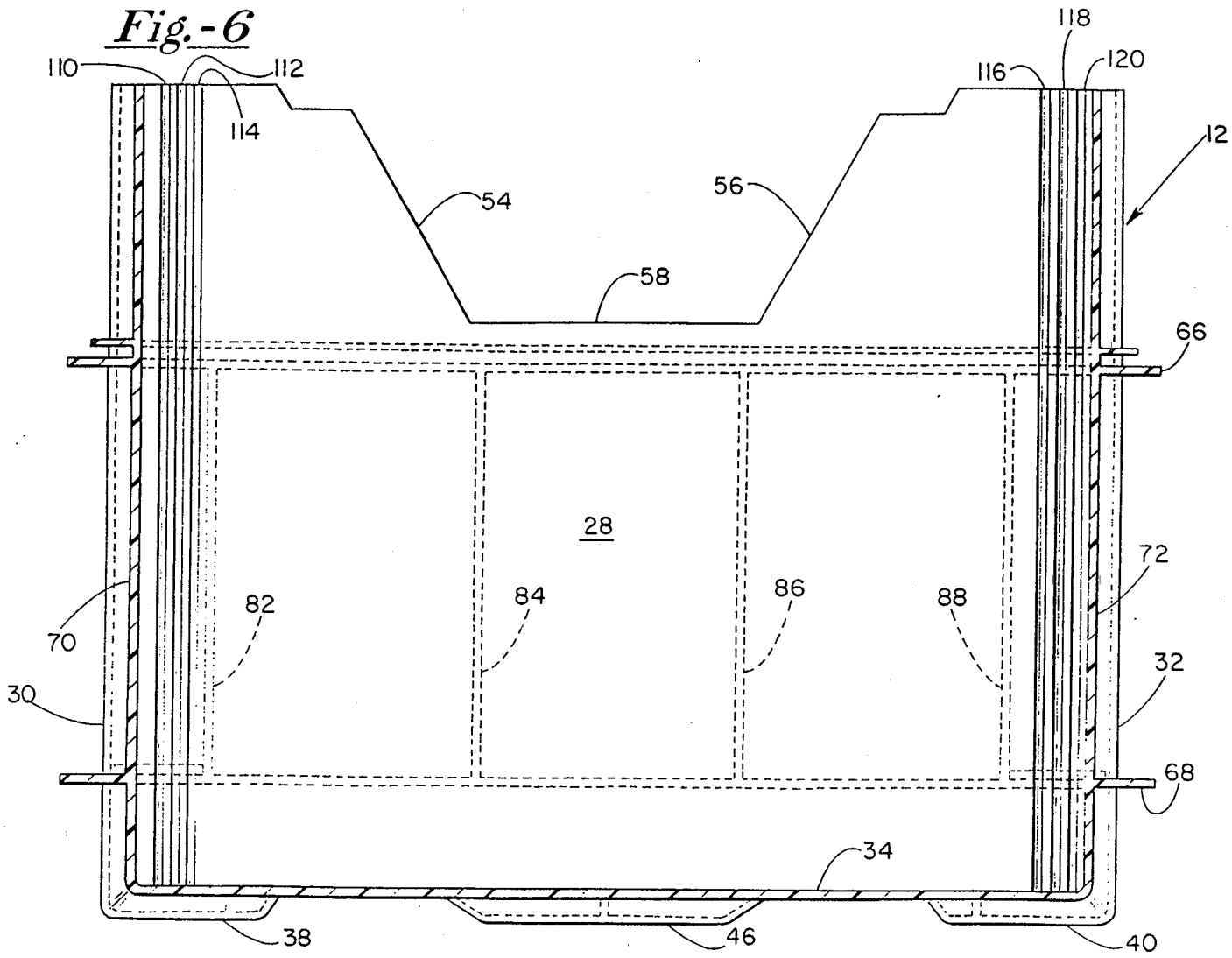
FIG. 6 is a cross sectional view of the base of the present invention with exterior features of the base shown in hidden line.
Figure 7:
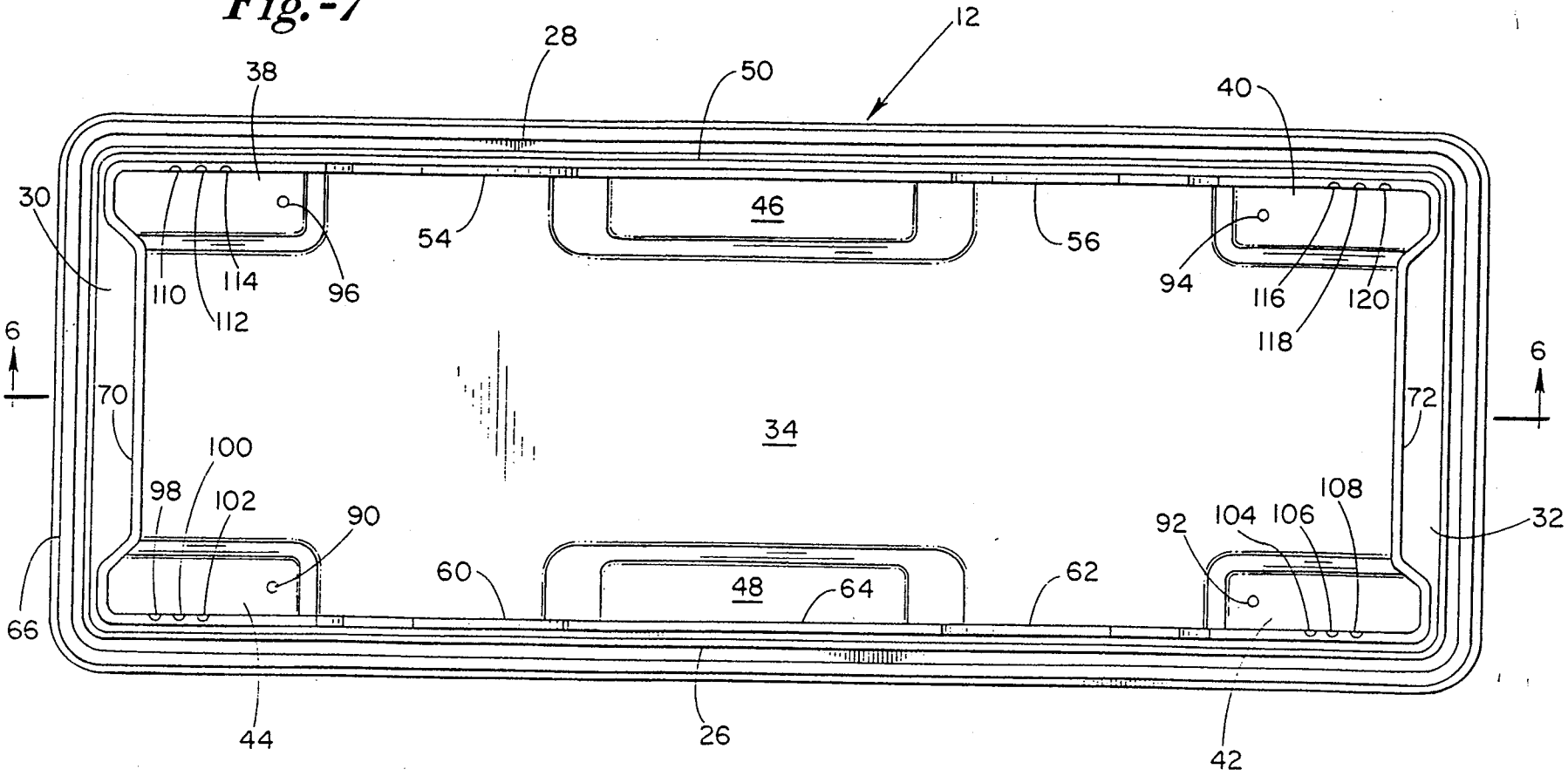
FIG. 7 is a top plan view with the base of the present invention.

The front wall 26 includes four vertical, parallel outer support members 74, 76, 78 and 80 which extend between the support ledges 66 and 68. These support members 74, 76, 78 and 80 provide support to the container and also provide gripping surfaces for robotic tools. The back wall has four identical vertical parallel outer support members 82, 84, 86 and 88, which are shown in hidden line on FIG. 6.

The interior surfaces of the base 12 are generally planar. The floor 34 is recessed in six areas which form the six support members 38, 40, 42, 44, 46 and 48 of the container. Projecting upwardly from the recesses situated near the base corners are four posts 90, 92, 94 and 96 to which the bottom support cushion 20 is secured.

The interior of front wall 26 contains three parallel vertically oriented slots 98, 100 and 102 on a first side of the interior surface and a second set of three parallel vertically oriented slots 104, 106 and 108 on the opposing side of the interior surface. These slots extend between the upper surface of the floor 34 and the upper portion of wall 26 adjacent the cut-out area 52. Likewise, wall 28 has a first set of three slots 110, 112 and 114. They are aligned with slots 98, 100 and 102 of wall 26. A second set of slots 116, 118 and 120 located on wall 28 are aligned with and opposing corresponding slots 104, 106 and 108 on wall 26. These slots are used for securing the side cushions as will be explained later.

Figure 14:
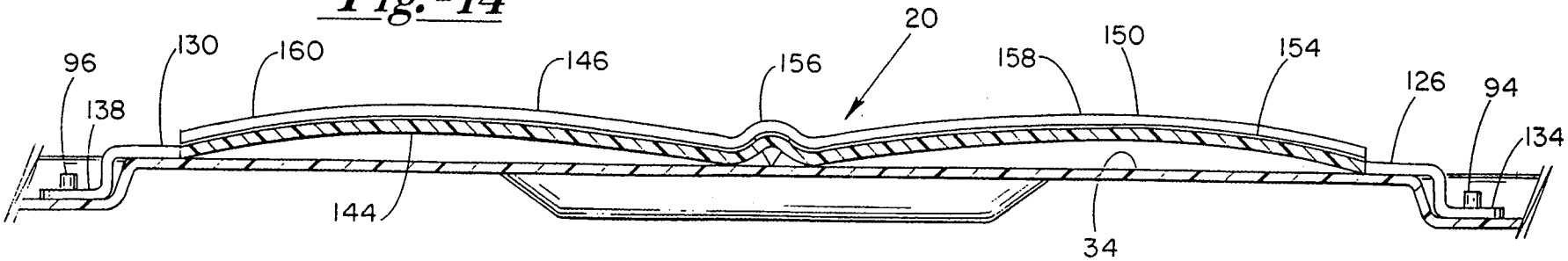
FIG. 14 is a cross sectional side view of the base cushion of the present invention taken along line 14—14 of FIG. 11.

Turning now to FIGS. 11–14, the bottom support cushion 20 will now be described. Bottom support cushion 20 is preferably integrally formed of an elastomeric material. The bottom support cushion 20 has a main body 122 and an arcuate profile as shown in FIG. 14. Projecting outwardly from each corner of main body 122 are tabs 124, 126, 128 and 130. At the ends of each tab are post receiving members 132, 134, 136 and 138. These post receiving members have holes sized and positioned to mate with one of the posts 90, 92, 94 and 96 which project upwardly from four of the six support members of base 12.

The main body 122 has a smooth bottom surface 144 and a top surface 146 characterized by a plurality of display receiving members. One such display receiving member is designated as 148. Between each member 148 are side wall members shown as 150 and 152. At the base of each member is support wall 154. The support wall 154 contains ridges of varying sizes, and designated generally as 155. These ridges allow flat panel displays of varying sizes to be retained in the package.

FIG. 14 is a cross section through bottom support cushion 20. As shown, the main body 122 has an arcuate profile and is divided into an arched center section 156 and convex outer sections 158 and 160. The outer sections 158 and 160 bow outwardly when in the relaxed position. When displays are inserted into the display receiving members 148, the outer sections 158 and 160 are pushed downwardly. The center section 156 acts as a firm, but not rigid, stop and allows the outer sections 158 and 160 to spread laterally as they are pushed downwardly. This arrangement provides a secure supporting arrangement for the flat panel displays and prevents the flat panel displays from slipping into adjacent panel receiving members.

Figure 8:
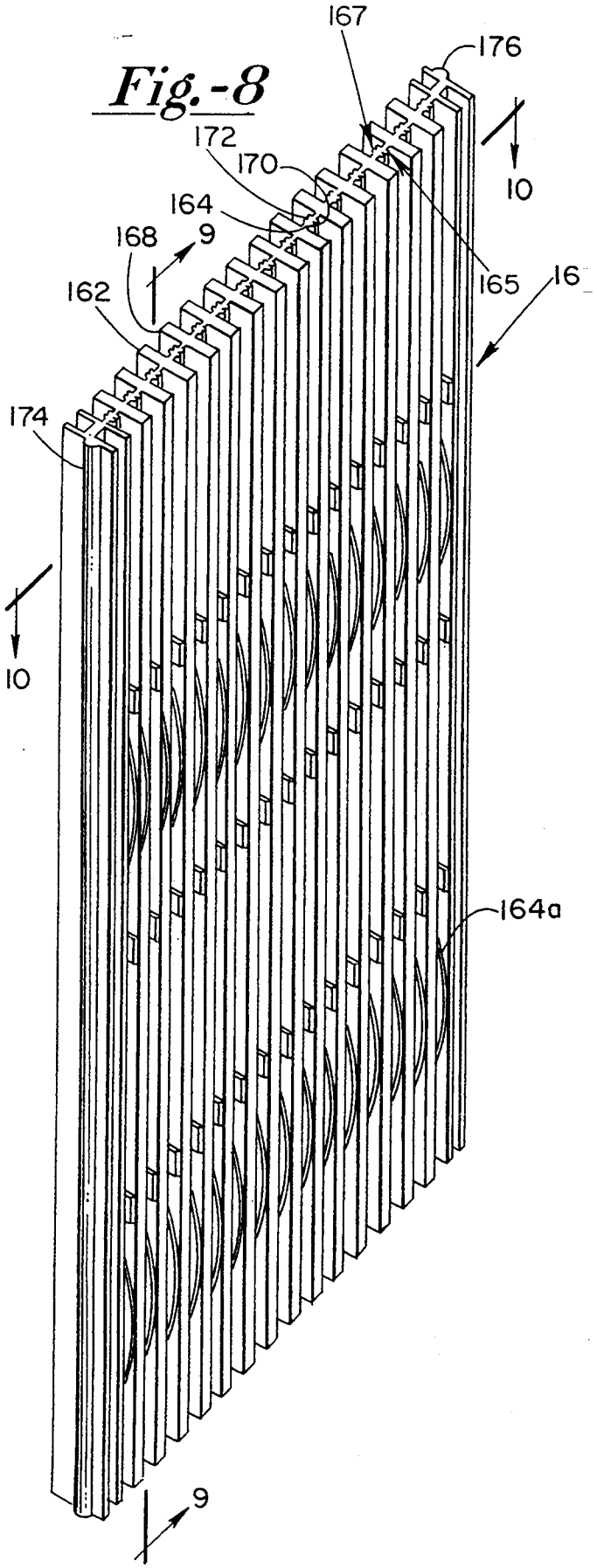
FIG. 8 is a perspective view of a side support cushion of the present invention.
Figure 9:
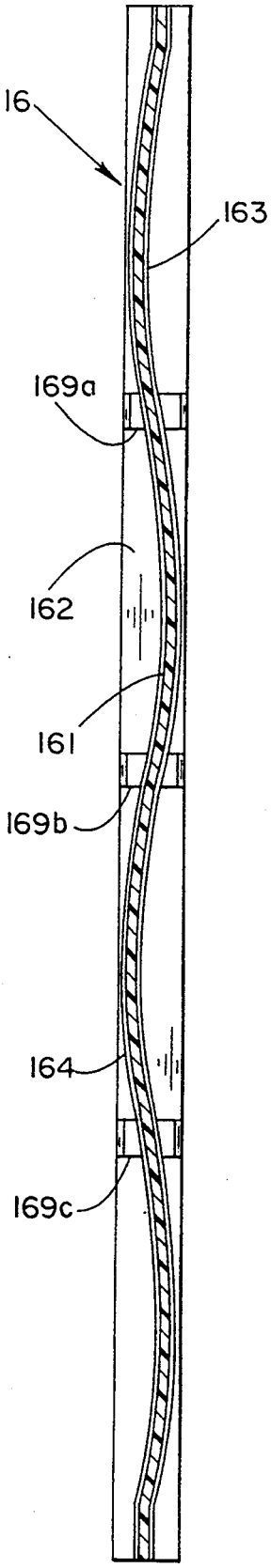
FIG. 9 is a cross sectional view of the side support cushion of the present invention taken along line 9—9 of FIG. 8.
Figure 10:
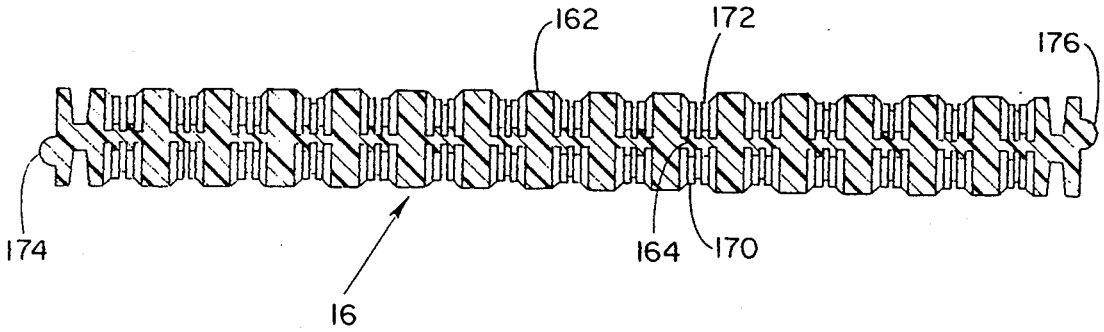
FIG. 10 is a cross sectional view of the side support cushion of the present invention taken along line 10—10 of FIG. 8.
Figure 11:
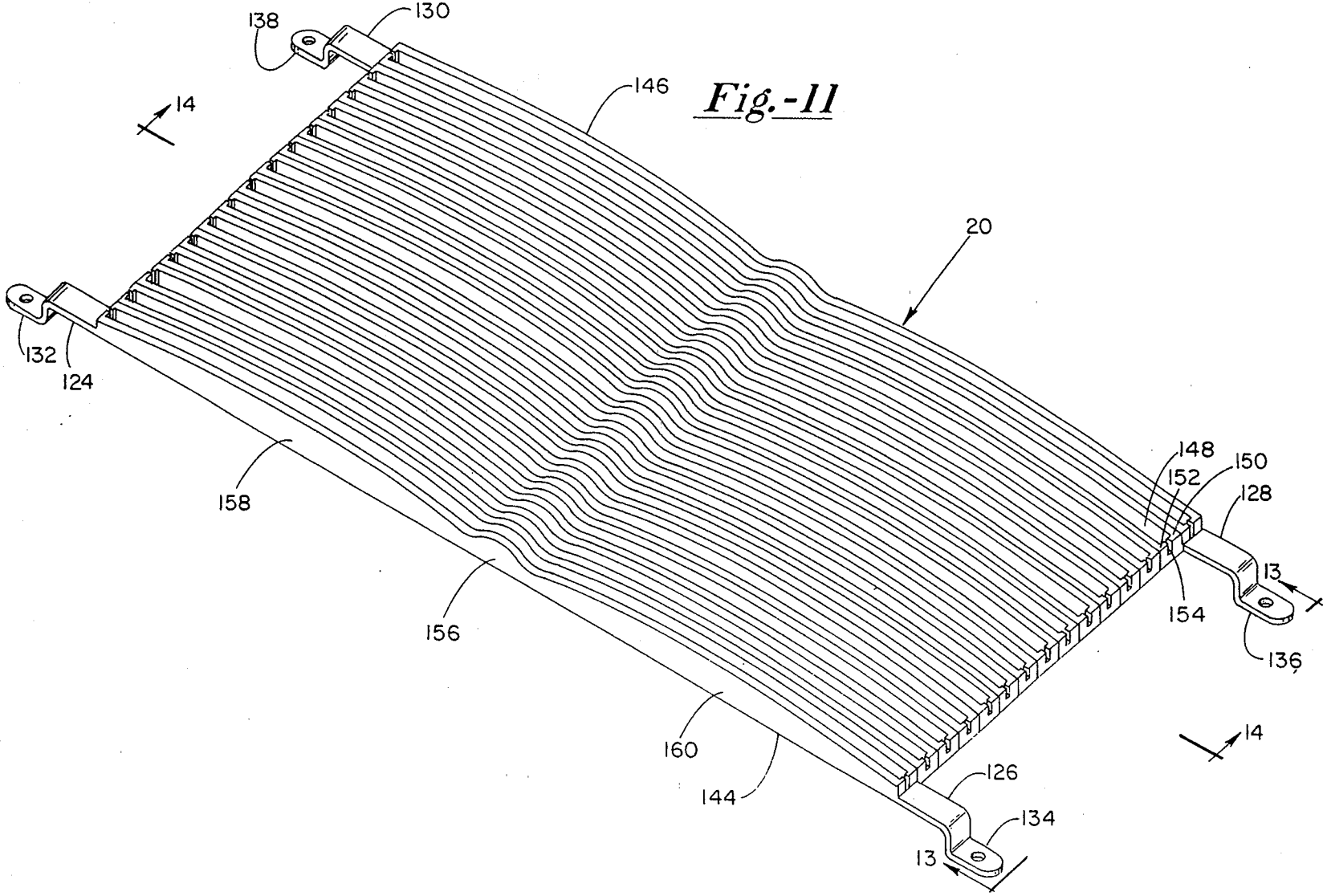
FIG. 11 is a perspective view of the bottom support cushion of the present invention.
Figure 12:
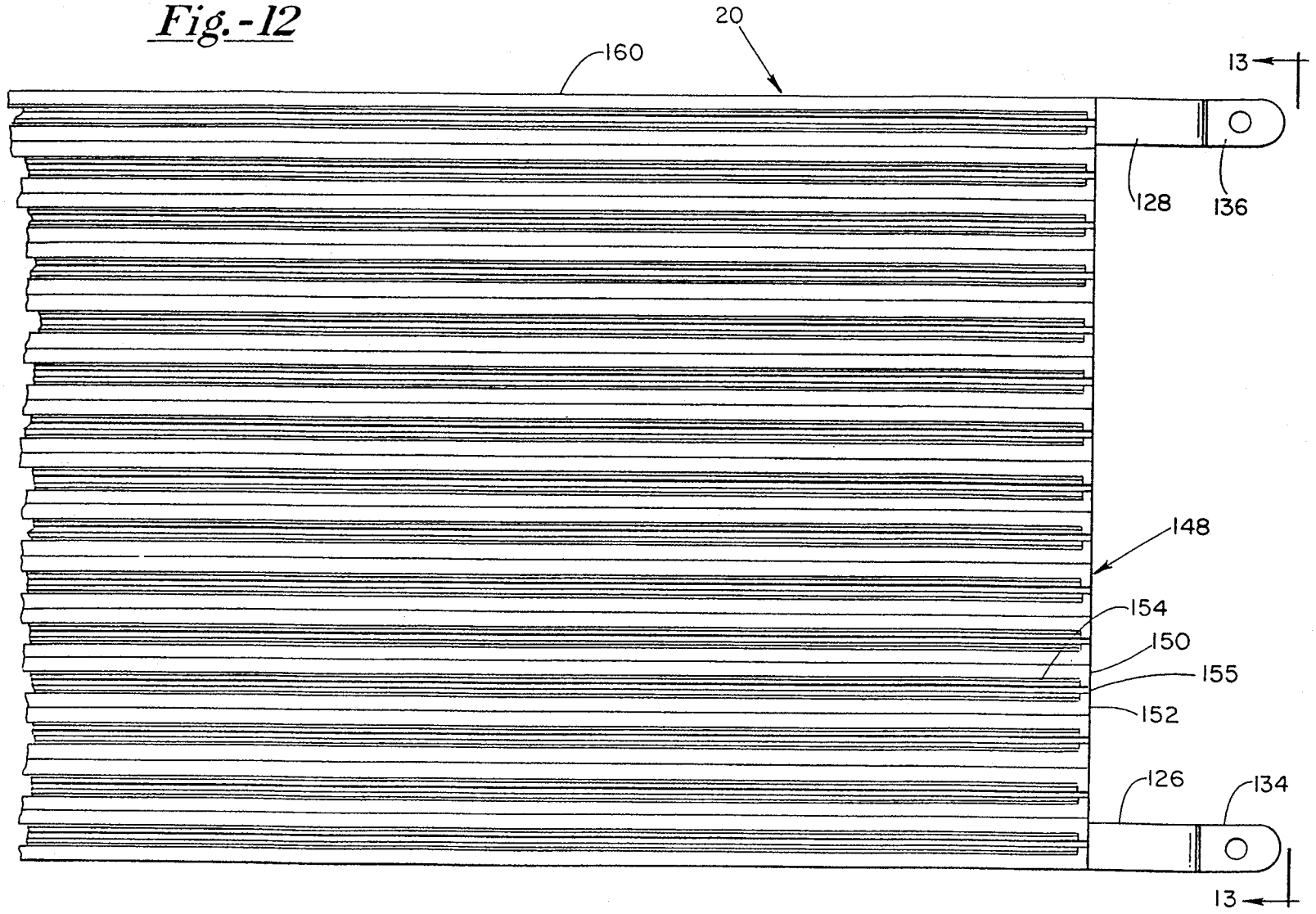
FIG. 12 is a top plan view of one end of the bottom support cushion of the present invention.
Figure 13:
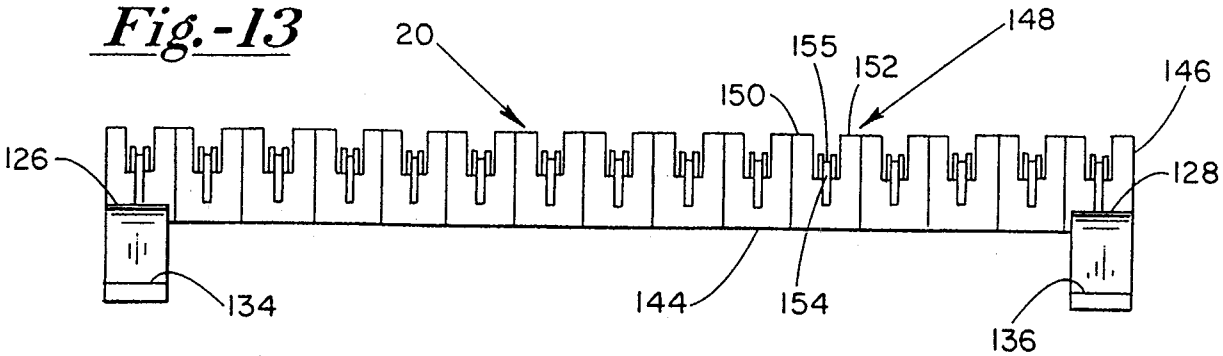
FIG. 13 is a end view of the bottom support cushion of the present invention.

The side support cushions 16 and 18 are identical in construction. Like the bottom cushion 20, the side support cushions 16 and 18 are made of an elastomeric material for resilient flexible support. The side support members 16 and 18 each have a series of rectangular shaped wall members, one of which is designated as 162 separated from each other by a wall one of which is designated as 164. Wall supports **169*a–c* are spaced apart the wall's length. The wall 164 is arcuate in shape, with convex areas, such as at 161, and concave areas, such as at 163, as shown in FIG. 9. A convex area of wall 164 is indicated as 164*a* in FIG. 8. A plurality of ridges designated generally as 165 and 167 which project outwardly in either direction from wall 164. The ridges vary in size, in a manner similar to the ridges 155 located on the bottom cushion. As shown, the wall 164 in cooperation with the wall members 162 create a set of flat panel display receiving members opening to a first side, one is shown as 172, and a set of flat panel display receiving members opening to a second side, one is shown as 172, of each of the side support cushions 16 and 18**.

Figure 3:
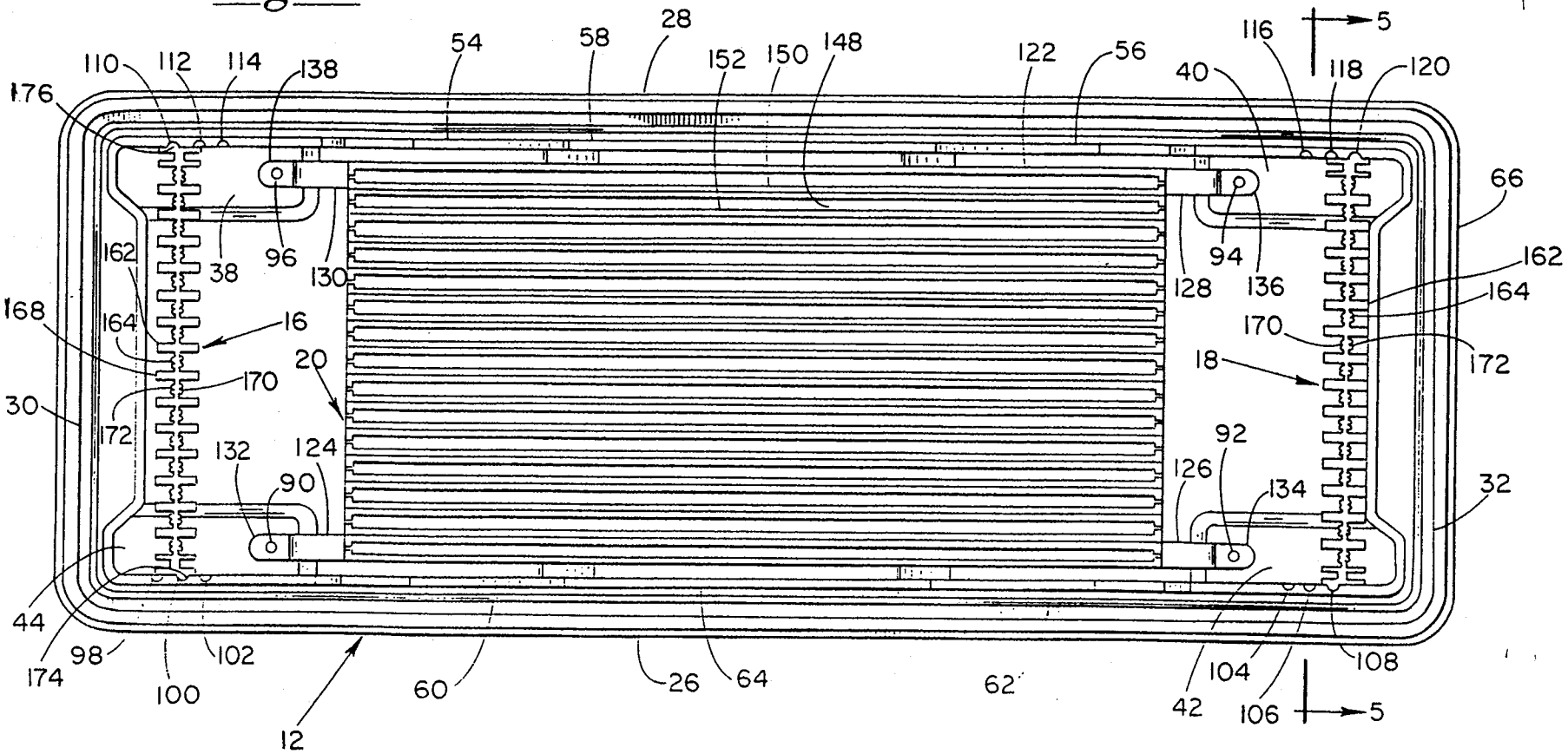
FIG. 3 is a top plan view of the base containing the support cushions of the present invention.
Figure 4:
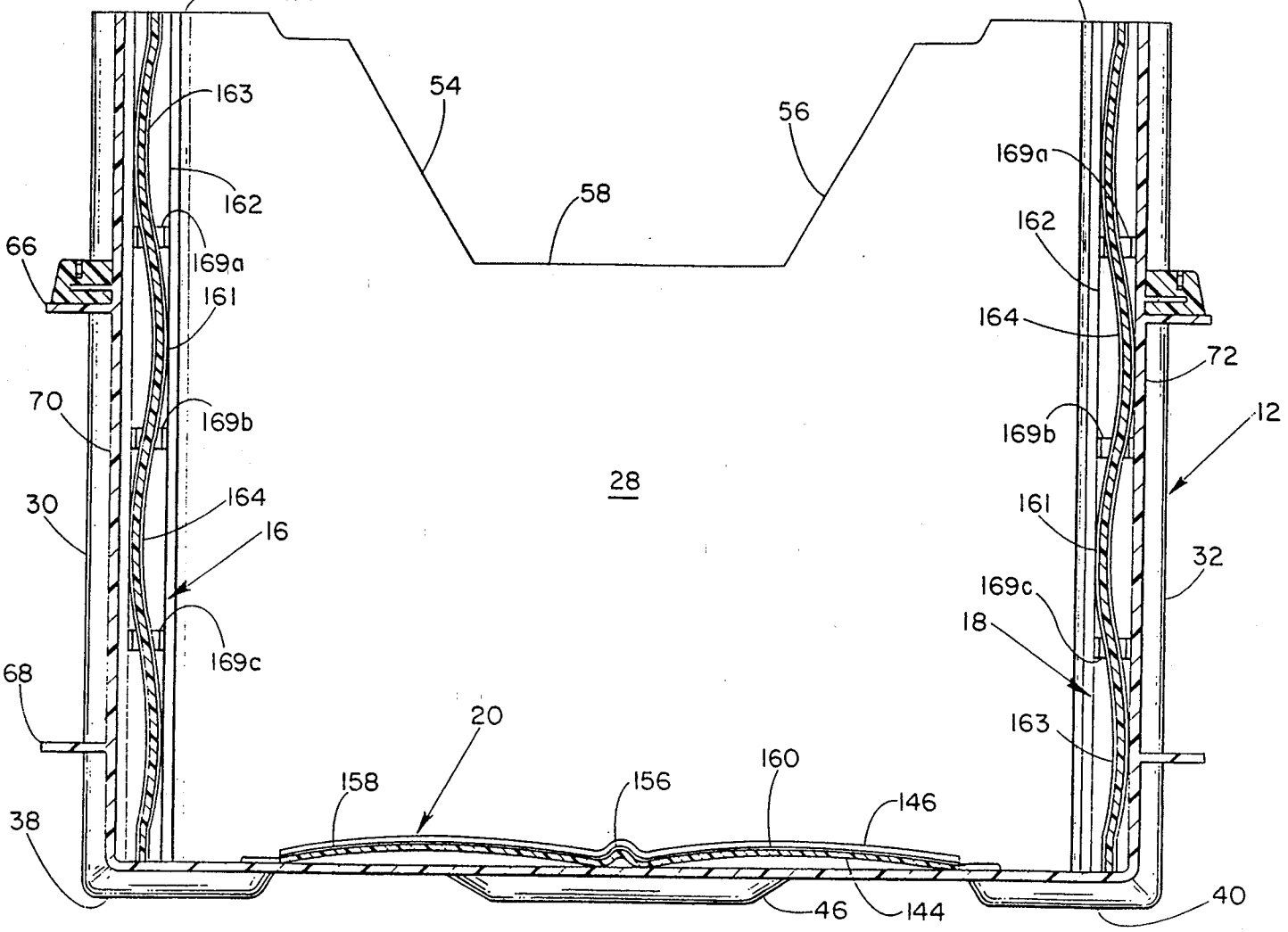
FIG. 4 is a cross sectional view of the base containing the support cushions of the present invention.
Figure 5:
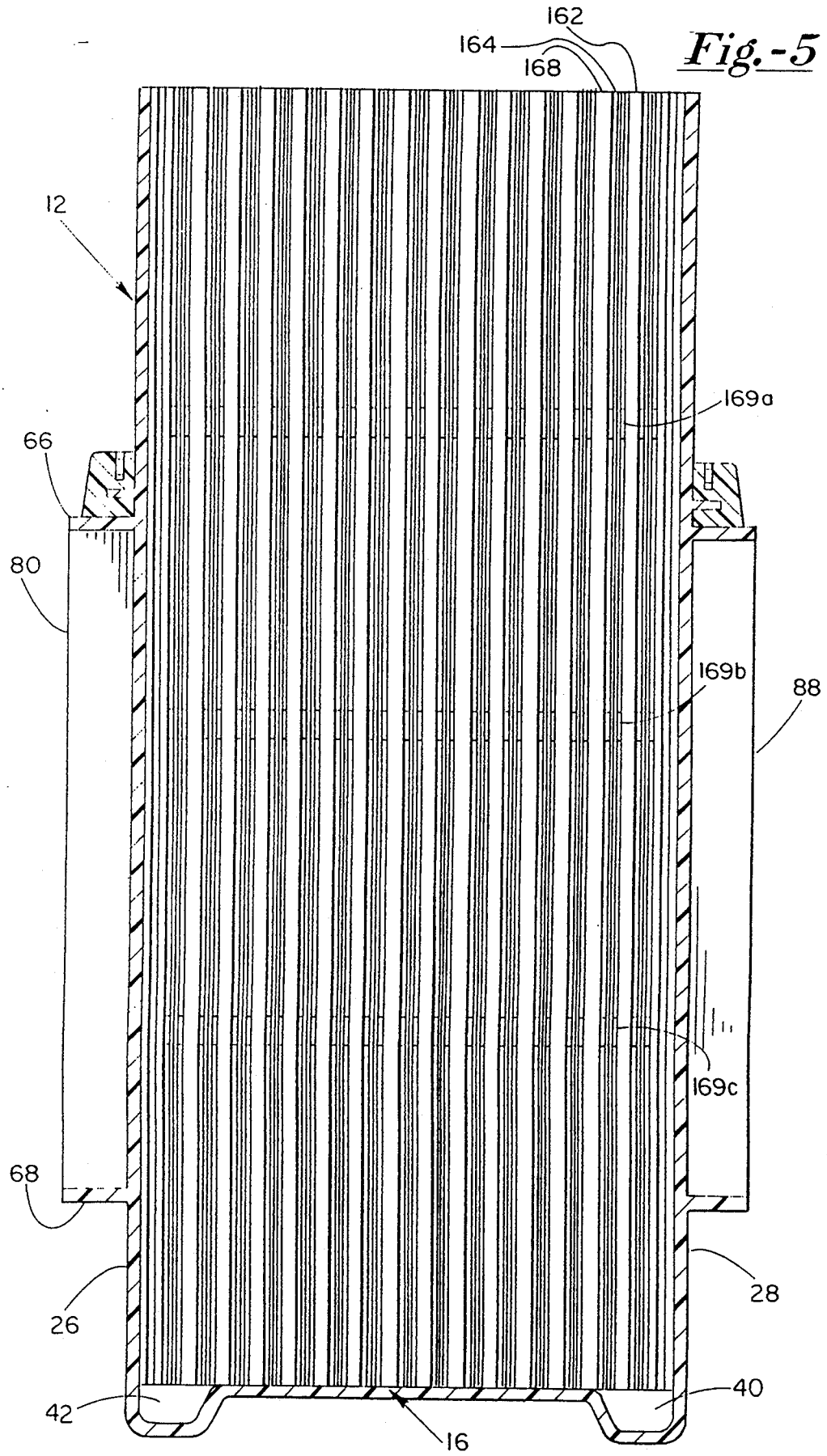
FIG. 5 is a cross sectional end view of the base containing cushions of the present invention.

Each side support cushion 16 and 18 includes an elongated bead 174 projection from one end and an elongated bead 176 projection from the other end. The beads 174 and 176 run parallel along the length of the cushion and are offset from each other as shown in FIGS. 2, 3, 8 and 10. Thus, bead 174 is closer to the first side 175 of the support cushion and the other bead 176 is closer to the second side 177. The beads 174 and 176, as shown in FIG. 3 are shaped to mate with any of the slots 98, 100, 102 or 110, 112 and 114 located in the base 12 to hold the side support cushions in the desired position. This permits the spacing between the two side support members to be adjusted to accommodate flat panel displays of different lengths. Additionally, the arrangement shown in the drawings can accommodate flat panel displays of ten different lengths by using different slots 98–120, and by flipping the side support members 16 and 18.

Figure 15:
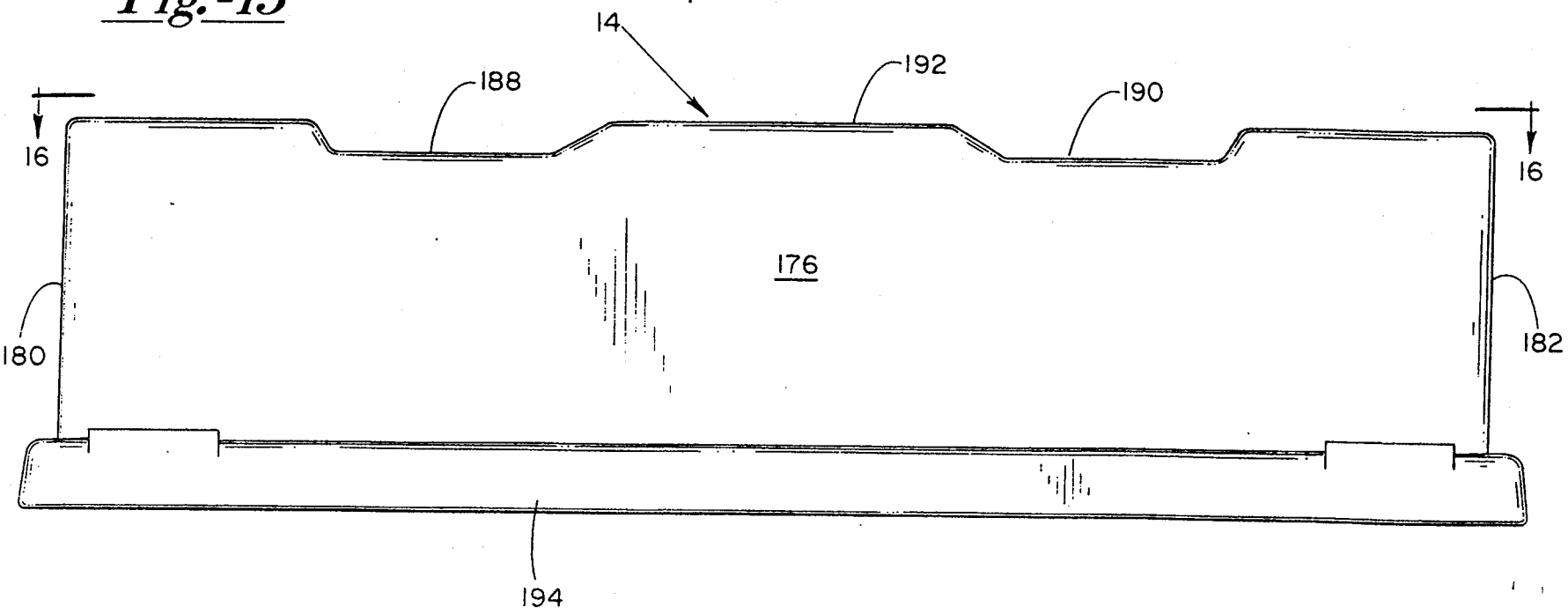
FIG. 15 is a side view of the cover of the present invention.
Figure 16:
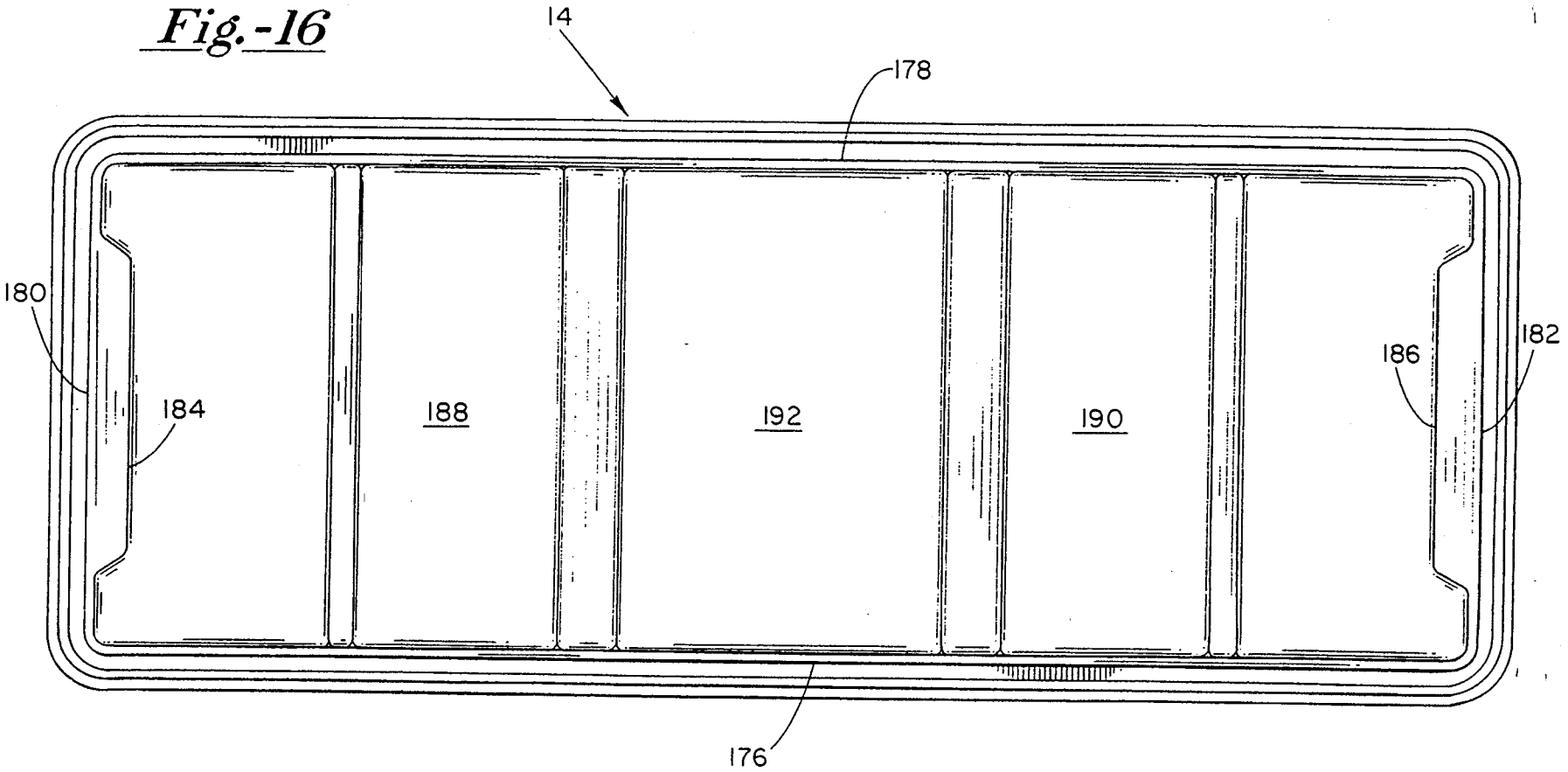
FIG. 16 is a top plan view of the cover of the present invention.

Turning now to FIGS. 15–17, cover 14 will now be described. Cover 14 is integrally formed of a rigid plastic. Many suitable materials are available. The material chosen should be able to withstand harsh chemicals or high temperatures without deforming. Such materials include polycarbonate or olefinic plastics. Cover 14 comprises a front wall 176 and an identical rear wall 178. Side walls 180 and 182 have a recessed planar area formed by panel members 184 and 186. The corners between the panel members 170 and 172 and the adjoining ends of the front wall 176 and rear wall 178 are rounded. The cover further has a pair of indentations 188 and 190.

Cover 14 also includes an intermediate member 192 which is positioned between indentations 188 and 190. When the cover is in place on the base, indentations 188 and 190 retain the flat panel displays within the notches 114 of the bottom support cushion 20 and the slots 150 of the side support cushions 16 and 18.

The cover includes a ledge 188 which projects outwardly from the bottom of the front wall 160, the rear wall 162 and two side walls 164 and 168. Projecting downwardly from ledge 188 is a lip 190. The cover is dimensioned so that when it is placed onto the base the bottom of ledge 188 contacts the top surface of ledge 60 of the base and the lip 190 projects downwardly over the ledge 60. This arrangement ensures full closure of the top of the base and the cut-out areas 50 and 52. An airtight seal is preferably formed when the cover and base are secured together.

MODE OF OPERATION

The operation of the flat panel display package 10 will now be described. The three support cushions 16, 18 and 20 are first inserted into the base 12. The base support cushion 20 is first positioned so that the body portion 132 rests on the floor 34 and the tabs 124, 126, 128 and 130 extend down into the recesses of the floor forming the base support members 38, 40, 42 and 44. Each tab receiving member 132, 134, 136 and 138 mates with the respective posts 90, 92, 94 and 96 projecting upwardly from the recess of floor 34. Once the base support cushion 20 is secured, the side support cushions 16 and 18 may be inserted.

Prior to inserting each side support cushion 16 and 18, the user must determine which slots 98–120 of the interior surface will be used and which side of the side support cushion will be used for engaging the flat display panel. This determination depends on the size of the flat panel displays. Once that is determined the beads 174 and 176 are inserted into the proper slot on the interior surfaces.

The flat panel displays may now be placed into the container. The base support cushion 20 receives the lower edge of the flat panel display with the notches and the side support cushions receive the side edges within the notches. Once all the flat panel displays are inserted into the base 12, the cover 14 may be placed on. The rails of the cover retain the flat panel displays within the notches of the base support cushion 20. Also, the outer sections 124 and 126 of the base support cushion 20 spread laterally as the cover presses down onto the flat panel displays.

It is to be understood that the above disclosure of the presently preferred embodiment of the invention is to be taken as illustrative of the invention. Furthermore, it is to be understood that those of skill in the art be capable of making modifications without departing from the true spirit and scope of the invention.

I claim:

1. An apparatus for packaging, storage and transportation of flat panel displays, said apparatus comprising:

(a) a base having four integral walls extending from a bottom surface, said four integral walls having a first interior surface with a plurality of first cushion receiving slots and a second interior surface with a plurality of second cushion receiving slots;

(b) a removable base cushion located in said base, said removable base cushion having a plurality of first flat panel display receiving members;

(c) a first removable side cushion located in said base having a plurality of second flat panel display receiving members said first removable side cushion configured to selectively mate with one of said first cushion receiving slots and with one of said second cushion receiving slots;

(d) a second removable side cushion located in said base having a plurality of third flat panel display receiving members, said second removable side cushion configured to selectively mate with one of said first cushion receiving slots and with one of said second cushion receiving slots whereby said first and second removable cushion selectively accommodate flat panel displays of varying size; and (e) a cover for mating with said base.

2. The apparatus of claim 1 and further including (a) a plurality of first ridges on each said first flat panel receiving member;

(b) a plurality of second ridges on each said second flat panel receiving member; and (c) a plurality of third ridges on each said third flat panel receiving member.

3. The apparatus of claim 1 wherein said base cushion has an arcuate profile having a first convex section, a second convex section and a center arch section disposed therebetween.

4. The apparatus of claim 1 wherein said plurality of second flat panel display receiving members has an arcuate profile with at least one convex portion and at least one concave portion.

5. The apparatus of claim 1 wherein said plurality of third flat panel display receiving members has an arcuate profile with at least one convex portion and at least one concave portion.

6. The apparatus of claim 1 and further including said base cushion having extending tabs for engaging posts located in said base.

7. An apparatus for packaging, storage and transportation of flat panel displays, said apparatus comprising:

(a) a base configured for robotic handling, having four integral walls extending from a bottom surface, said four integral walls having a first interior surface with a plurality of first cushion receiving slots and a second interior surface with a plurality of second cushion receiving slots, a first exterior surface having a plurality of first vertical support members protruding from said first exterior surface, a second exterior surface opposite said first exterior surface having a plurality of second vertical support members, a third exterior surface having a first indented area and a fourth exterior surface located opposite said third exterior surface, said fourth exterior surface having a second indented area, a first ledge surrounding said first, second, third and fourth exterior surfaces, said first ledge configured for mating with a cover of said apparatus and a second ledge surrounding said first, second, third and fourth exterior surfaces;

(b) a removable base cushion located in said base, said removable base cushion having a plurality of first flat panel display receiving members;

(c) a first removable side cushion located in said base having a plurality of second flat panel display receiving members, and said first removable cushion having a first securing means for selectively mating with one of said first cushion receiving slots and a second securing means for mating with one of said second receiving slots;

(d) a second removable side cushion located in said base having a plurality of third flat panel display receiving members, and said second removable cushion having a third securing means for selectively mating with one of said first cushion receiving slots and a fourth securing means for mating with one of said second cushion receiving slots.

8. The apparatus of claim 7 wherein said base cushion has an arcuate profile having a first convex section, a second convex section and a center arch section disposed therebetween.

9. The apparatus of claim 7 and further including (a) a plurality of first ridges on said first flat panel receiving members;

(b) a plurality of second ridges on said second flat panel receiving members;-and (c) a plurality of third ridges on said third flat panel receiving members.

10. The apparatus of claim 9 wherein said plurality of second flat panel display receiving members has an arcuate profile with at least one convex portion and at least one concave portion, said second ridges extending on either side of said second flat panel display receiving members.

11. The apparatus of claim 9 wherein said plurality of third flat panel display receiving members has an arcuate profile with at least one convex portion and at least one concave portion, said third ribs extending on either side of said third flat panel display receiving members.

12. The apparatus of claim 7 and further including said base cushion having extending tab members for engaging protruding posts located in said base.

13. The apparatus of claim 7 wherein said first securing means is a first elongated bead on a first side of said first removable side cushion and said second securing means is a second elongated bead on a second side of said first removable cushion, said second elongated bead is offset from said first elongated bead.

14. The apparatus of claim 7 wherein said third securing means is a third elongated bead on a first side of said second removable side cushion and said fourth securing means is a fourth elongated bead on a second side of said second removable cushion, said fourth elongated bead is offset from said third elongated bead.

* * * * *